United States Patent [19]

Iwamura et al.

[11] Patent Number: 4,785,982

[45] Date of Patent: Nov. 22, 1988

[54] WATCH CASE AND BAND ATTACHMENT STRUCTURE

[75] Inventors: Michihiro Iwamura, Sayama; Eiichi Kitabayashi; Masataka Matsumoto, both of Tokorozawa; Toshio Murata, Higashikurume; Tadao Enomoto, Higashimurayama; Junichi Nishikawa, Higashikurume, all of Japan

[73] Assignee: Citizen Watch Co., Ltd., Tokyo, Japan

[21] Appl. No.: 11,038

[22] Filed: Feb. 5, 1987

[30] Foreign Application Priority Data

Feb. 21, 1986 [JP] Japan ..... 61-37050
Jul. 25, 1986 [JP] Japan ..... 61-114155[U]

[51] Int. Cl.[4] ..... A44C 5/14

[52] U.S. Cl. ..... 224/177; 224/164; 368/282

[58] Field of Search ..... 224/164–177; 24/265 WS; 63/3–7; 368/282; D11/86, 3

[56] References Cited

U.S. PATENT DOCUMENTS

| | | | |
|---|---|---|---|
| 2,018,068 | 10/1935 | Kestenman | 224/164 X |
| 2,086,050 | 7/1937 | Schwalberg | 224/164 X |
| 3,495,748 | 2/1970 | Gandelman | 224/164 |
| 3,795,353 | 3/1974 | Weiss | 224/177 |
| 3,897,612 | 8/1975 | Bert | 224/177 X |
| 4,231,502 | 11/1980 | Meyerson | 224/177 |
| 4,389,006 | 6/1983 | Nagata | 224/164 |
| 4,432,476 | 2/1984 | Yokosuka | 224/164 |
| 4,593,842 | 6/1986 | Koenuma | 224/164 X |
| 4,624,581 | 11/1986 | Mock et al. | 224/164 X |

*Primary Examiner*—Charles E. Phillips
*Assistant Examiner*—Linda J. Sholl
*Attorney, Agent, or Firm*—Koda and Androlia

[57] ABSTRACT

A structure comprising a watch case; a pair of lugs each extending from the watch case and having an upper surface in a lower position than the upper surface of the watch case; a band; and a connector secured to the underside of the end portion of the band, the band being closely attached to the watch case by placing the end of the band on the upper surfaces of the lugs and tightening cone point screws into threaded holes provided near distal ends of the sides of the lugs so that the cone points of the screws hold firmly a pair of attachment openings provided in said connector against the watch case.

1 Claim, 5 Drawing Sheets

WATCH CASE AND BAND ATTACHMENT STRUCTURE

BACKGROUND OF THE INVENTION

1. Field of the Invention

This invention relates to a watch case and band attachment structure.

2. Description of the Related Art

In a conventional watch band attachment structure, as shown in the perspective view of FIG. 1 and the sectional view of FIG. 2, a watch case 1 and a watch band 2 are connected by means of a spring bar 3. The watch case 1 is provided with lugs 1*c* having holes 1*a* for inserting pins 3*a* of the spring bar 3 and a connector hook receiving portion 1*b* for receiving a connector hook 2*a* of a connector 2'. The connector 2' is soldered to the band 2 and holds the spring bar 3 (UK Pat. No. 2,129,280).

In the above-mentioned conventional structure, however, lugs 1*c* must be provided with holes 1*a* in their ends. For this reason, as the holes 1*a* approach nearer to the distal ends of the lugs 1*c*, the lugs 1*c* lower further and a difference H between the lower surface of the watch case 1 and the lower surface of the lug 1*c* becomes larger. Thus, there poses a problem on the appearance.

SUMMARY OF THE INVENTION

It is an object of the invention is to keep the attractive appearance of a watch viewed from the side by preventing the lower surfaces of lugs of the watch case from lowering excessively with respect to the lower surface of the watch case when the watch case is viewed from the side.

Another object of the invention is to provide an attachment structure in which the connector is reduced in length in the direction of the width of the band so that it can also be used for women's narrow watch bands.

This invention has a structure including a watch case; a pair of lugs each extending from the watch case, being provided with a threaded hole near a root portion of each of the sides of the watch case and having an upper surface in a lower position than an upper surface of the watch case; a band; a connector secured to an underside of an end portion of the band; a pair of cone point screws, the connector being bent into a U shape to define a base wall and a pair of side walls and being secured in a direction of a width of the band, with the side walls held downward viewed from an upper side of the band, the side walls being provided with a pair of attachment openings, the band being closely attached to the watch case by placing the end portion of the band on the upper surfaces of the lugs and tightening the cone point screws respectively into the threaded holes of the sides of the lugs so that the cone points of the screws hold firmly portions near the case, of outer peripheral edges of the pair of attachment openings provided in the connector against the watch case; and a bend preventing member provided between the pair of the walls of the connector for preventing the walls from being bent by force exerted from outside to inside by the screws.

BRIEF DESCRIPTION OF THE DRAWINGS

FIGS. 3 to 6 are views illustrating a first embodiment of the invention, in which FIG. 3 is a perspective view illustrating lugs 6 extending from a watch case 11; FIG. 4 is a sectional view illustrating the connected state of the lugs 6 and a band 4 and is taken along the line IV—IV of FIG. 5 and viewed in the direction of the arrows; FIG. 5 is a perspective view of a band end 4*a* viewed from the underside thereof; and FIG. 6 is a partially sectional view taken along the line VI—VI of FIG. 4 and viewed in the direction of the arrows.

FIGS. 7 to 9 are views illustrating a second embodiment of the invention, in which FIG. 7 is a view of the appearance of a watch case 11 having an extension 6*c*; FIG. 8 is a sectional view illustrating the connected state of the watch case and a band 4 and is taken along the line VIII—VIII of FIG. 7 and viewed in the direction of the arrows; and FIG. 9 is a perspective view of a connector 5 of the band.

FIGS. 10 to 12 are views illustrating a third embodiment of the invention, in which FIG. 10 is a sectional view illustrating the connected state of a watch case 11 and a band 4; FIG. 11 is a sectional view illustrating a band end 4*a* and the state before and after bending a connector 5 at its bending portion 5*d*; and FIG. 12 is a perspective view illustrating the attached state of the connector to the underside of the band end.

DETAILED DESCRIPTION OF THE PREFERRED EMBODIMENTS

The invention will now be described in detail with reference to the drawings.

In the first embodiment shown in FIGS. 3 to 6, a connector 5 is bent into a U shape so as to define a base wall 5*c* and a pair of side walls 5*b* and 5*b*, and both the bent side walls are provided with a pair of opposed attachment openings 5*a* and 5*a*. The center base wall 5*c* of the connector 5 is attached to an underside 4*c* of a band end 4*a*.

Figure 1:
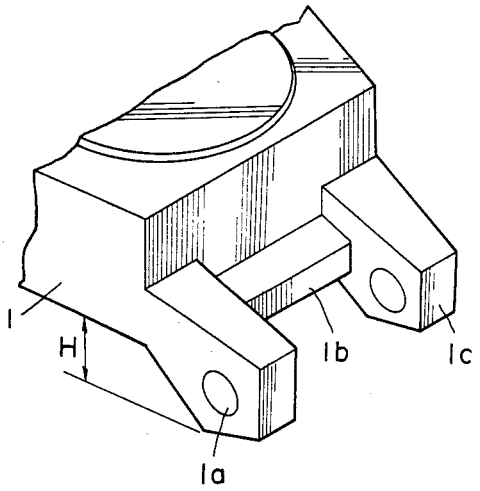
FIG. 1 (PRIOR ART)
FIG. 1 is a perspective view of a watch case and lugs of a conventional structure.
Figure 2:
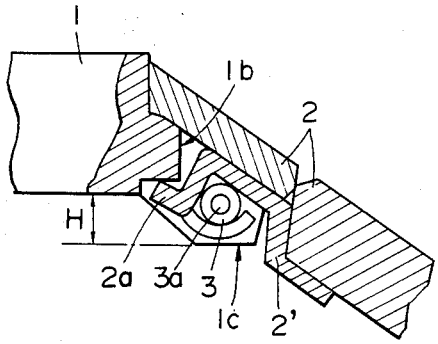
FIG. 2 (PRIOR ART)
FIG. 2 is a sectional view illustrating the connected state of the watch case and a band of the conventional structure.
Figure 3:
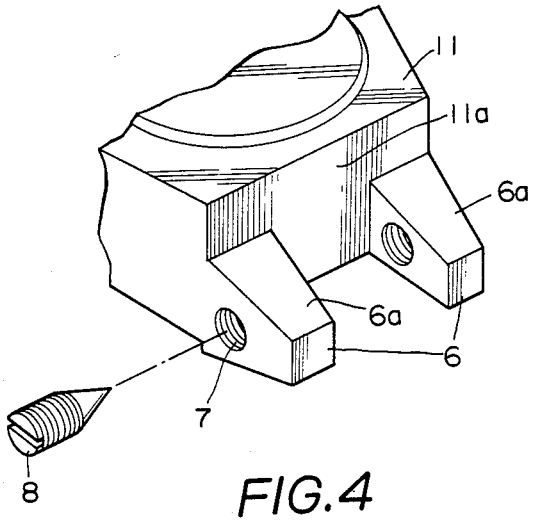
Figure 4:
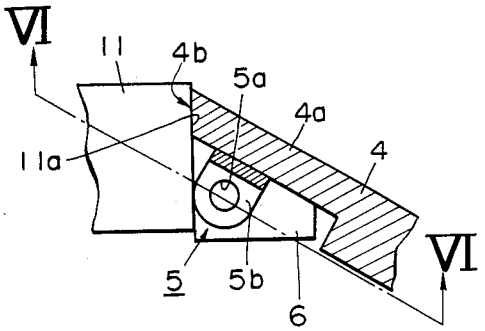
Figure 5:
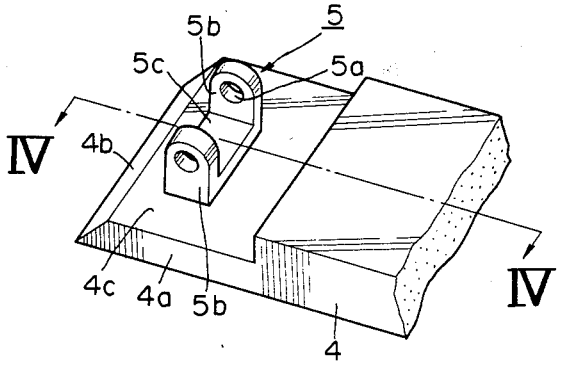
Figure 6:
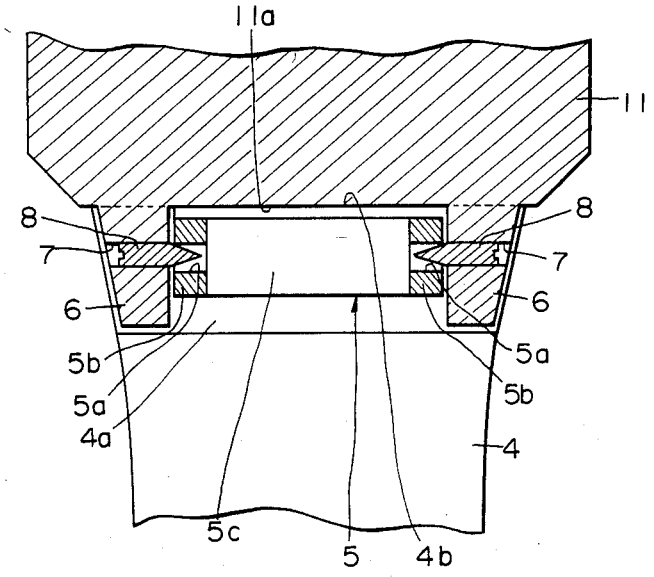

The watch case and the band are attached as follows:

First, the underside 4*c* of the band end 4*a* is placed on the upper surfaces of a pair of lugs 6*a* and 6*a* of the watch case 11, then cone point screws 8 and 8 are tightened into threaded holes 7 and 7 provided in the sides 5*b* and 5*b* of the lugs 6 and 6 from the outside. Thus as shown in FIG. 6, as the screws 8 and 8 are rotated and driven into the threaded holes 7 and 7, the tapered surfaces of the cone points of the screws 8 and 8 engage with the abutment portions of the openings 5*a* and 5*a* in the connector 5 so that the band 4 together with the connector 5 is held against the watch case 11 and thus an edge 4*b* of the band 4 is attached to a side wall 11*a* of the watch case 11 without any clearance.

Figure 7:
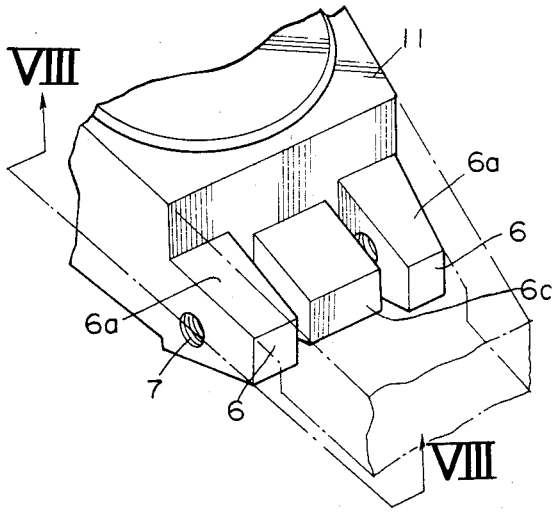
Figure 8:
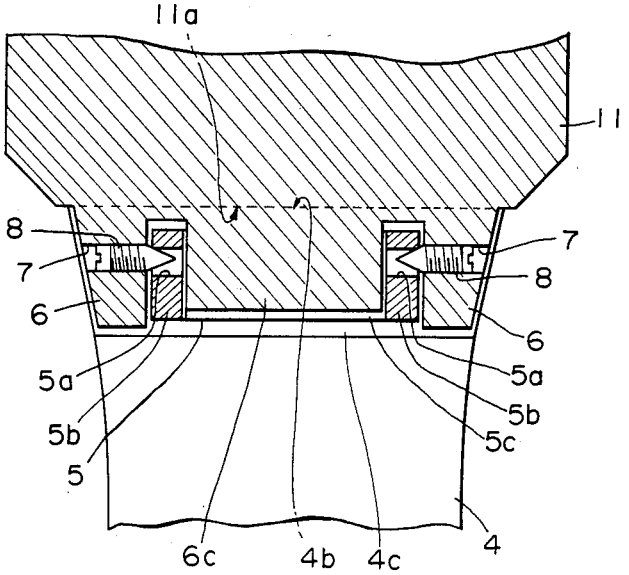
Figure 9:
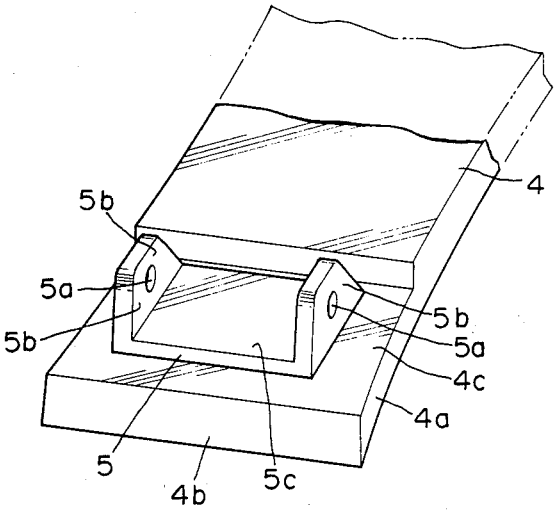

The second embodiment shown in FIGS. 7 to 9 will be explained.

11 denotes a metal watch case, and on its side wall in the direction of attaching a band, there are provided a pair of spaced lugs 6 and 6 and an extension 6*c* in the center portion between both lugs 6 and 6. The lugs 6 and 6 have a pair of opposed threaded holes 7 and 7, respectively. 4 denotes a metal band provided with a stepped face 4*c* on the underside of its end 4*a*. 5 denotes a connector formed by bending a metal plate into a U shape, comprising a center base wall 5*c* and a pair of side walls 5*b* and 5*b* opposed at both sides of the base wall 5*c*. The side walls 5*b* and 5*b* have a pair of opposed bored openings 5*a* and 5*a*, respectively. The connector 5 is soldered to the stepped face 4*c* of the band 4 at its base wall 5*c* so that the side walls 5*b* and 5*b* are opposed in the direction of the width of the band and are suspended in the direction of the underside of the band. 8 denotes cone point screws.

Now, the procedure for assembling the watch case 11 and band 4 will be explained. First, the side walls 5*b* and 5*b* of the connector 5 on the band 4 are inserted in gaps in the watch case 11 defined between the extension 6*c* and each of lugs 6 and 6, and screws 8 and 8 are tightened into threaded holes 7 and 7, respectively to engage the cone points of the screws 8 and 8 with the openings 5*a* and 5*a*.

Furthermore, as the screws 8 and 8 are tightened so that the points thrust into openings 5*a* and 5*a*, the band 4 is brought close to the watch case 11. The upper side of a side wall 11*a* of the watch case 11 and an edge 4*b* of the band 4 are connected without any clearance. On the other hand, when the screws 8 are loosened, the band 4 can be removed from the watch case easily.

In the above structure of the second embodiment, even when the screws 8 and 8 are closely tightened, side walls 5*b* and 5*b* abut the extension 6*c* without bending inward, thereby preventing the appearance of the underside of the band attachment portion from being impaired.

As clearly shown in the above description, according to the second embodiment, the interposition of the extension provided on the watch case allows to prevent the deformation of the side walls of the connector, thus keeping the attractive appearance of the underside of the band attachment portion. In addition, since the thickness of the connector can be reduced, the connector can easily be formed and miniaturized.

Figure 10:
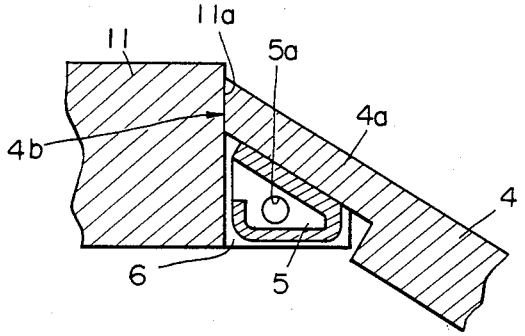
Figure 11:
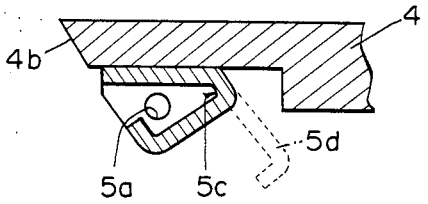
Figure 12:
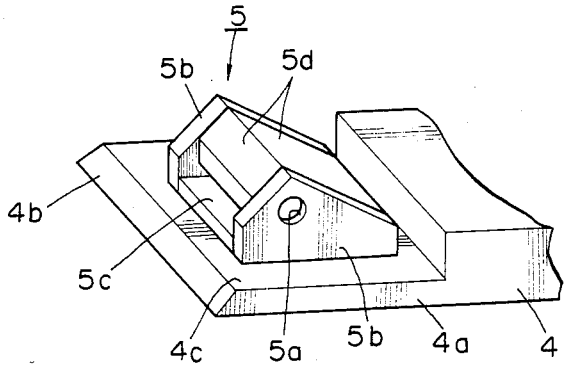

In a third embodiment shown in FIGS. 10 to 12, a connector 5 is bent in the longitudinal direction of a band 4 and comprises a pair of side walls 5*b* and 5*b* having opposed attachment openings 5*a* and 5*a* and a bending portion 5*d* having a section 5*c* struck and minimized in the direction of the width of the connector 5. This bending portion 5*d* is bent at the section 5*c* and inserted between the side walls 5*b* and 5*b* so as to occupy the space between the side walls 5*b* and 5*b* of the connector 5.

For attaching the band to the case, like the first and second embodiments, the band end 4*a* is placed on the upper surfaces of the lugs 6 and 6 of the watch case 11, then cone point screws 8 and 8 are tightened into threaded holes 7 and 7 provided in the sides of the lugs 6 and 6 from the outside. Thus, as the screws 8 and 8 are rotated and driven into the threaded holes 7 and 7, the cone points of the screws 8 and 8 push the attachment openings 5*a* and 5*a*. Thus the case and the band are tightly secured to each other.

The third embodiment has a simpler structure than the second embodiment. The structure of the third embodiment prevents the inside of the connector on the underside of the band from being deformed inward and covers the inside of the connector, thus improving the appearance of the underside of the band.

As described above, according to the structures of the invention, in any embodiment, the threaded holes in the sides of the lugs can be provided near the distal ends of the lugs, and the lower surfaces of the lugs approach the lower surface of the watch case accordingly, thus providing the attractive appearance of the watch viewed from the side. In addition, there is no possibility of injuring the wrist of the wearer because the connector at the attachment portion little extends from the lower surfaces of the lugs. Furthermore, since the connectors of the invention are small in width, they can also be used for women's narrow bands.

What is claimed is:

1. A structure comprising:

a watch case having front and back surfaces and at least two sides;

a pair of lugs each extending from one of said sides of said watch case and being provided with a threaded hole and having a top surface which is lower in position than said front surface of said watch case;

a band having a top side and an underside;

a pair of cone point screws;

a connector secured to the underside of an end portion of said band, said connector being bent into a U-shape to define a base wall and a pair of side walls and being secured in a direction of a width of the band, with said side walls extending downwardly as viewed from said top side of said band, said side walls being provided with a pair of attachment openings, said band being closely attached to the watch case by placing said end portion of the band on the top of the surfaces of the lugs and tightening the cone point screws respectively into the threaded holes of the side lugs so that the cone points engage with the pair of engagement openings provided in said connector; and a bending preventing member provided between said pair of said walls of said connector for preventing said side walls from being bent by force exerted from said cone point screws towards the inside, said bending preventing member comprising an extension extending from said watch case between said pair of lugs having a top surface in a lower position than the top surface of said pair of lugs, said extension supporting said base wall and also supporting said pair of side walls with a fixed base between said side walls.

* * * * *